United States Patent [19]

Bardes

[11] 4,305,575

[45] Dec. 15, 1981

[54] TOE-NAILING CLAMPING TOOL

[76] Inventor: Dale L. Bardes, 7050 N. Ridge Blvd., Chicago, Ill. 60645

[21] Appl. No.: 181,155

[22] Filed: Aug. 25, 1980

Related U.S. Application Data

[60] Division of Ser. No. 36,438, May 7, 1979, Pat. No. 4,238,123, which is a continuation-in-part of Ser. No. 885,955, Mar. 13, 1978, abandoned.

[51] Int. Cl.[3] ..... B25B 1/20

[52] U.S. Cl. ..... 269/41; 269/228; 269/261; 269/268; 269/283

[58] Field of Search ..... 81/367, 368, 370, 371, 81/420, 423, 425 A, 426; 269/41, 42, 404, 257, 258, 228, 268, 261, 283

[56] References Cited

U.S. PATENT DOCUMENTS

| | | | |
|---|---|---|---|
| 2,929,422 | 3/1960 | Tyler et al. . | |
| 3,083,007 | 3/1963 | Campfield | 269/904 |
| 3,181,181 | 5/1965 | Buckley et al. | 81/368 |
| 3,314,319 | 4/1967 | Schmidt | 81/367 |
| 3,456,702 | 7/1969 | Johnson . | |
| 3,653,284 | 4/1972 | Pynchon et al. . | |
| 3,663,004 | 5/1972 | Hupert | 269/904 |
| 3,808,870 | 5/1974 | Blancett | 81/423 |
| 3,963,230 | 6/1976 | Jankowski, Jr. . | |
| 4,165,746 | 8/1979 | Burgin | 81/423 |

*Primary Examiner*—Robert C. Watson
*Attorney, Agent, or Firm*—Frost & Jacobs

[57] ABSTRACT

A toe-nailing clamping tool that securely holds wood structural framing members in a fixed relationship to facilitate joining the members with increased accuracy and efficiency so as to provide increased strength. The tool is formed by a pair of oppositely disposed substantially L-shaped opposing jaws, each jaw being substantially L-shaped in cross-section and having barbed opposing surfaces. The jaws are supported in the fixed or detachable relationship by a pair of substantially C-shaped arms attached to plier-like handles of a leverage advantage locking plier, such that when the handles are squeezed together, the opposing jaws are locked into abutting contact with the wood structural framing members to permit accurate, efficient and structurally effective toe-nailing.

3 Claims, 12 Drawing Figures

TOE-NAILING CLAMPING TOOL

This is a division of application Ser. No. 036,438, filed May 7, 1979, now Pat. No. 4,238,123 which is a continuation-in-part of application Ser. No. 885,955, filed Mar. 13, 1978 and now abandoned.

BACKGROUND OF THE INVENTION

1. Field of the Invention

The present invention relates to a clamping device and more particularly to a clamping device for securely clamping two framing members together to facilitate their joining.

2. Description of the Prior Art

In construction there is frequently a need for fastening a series of vertical studs between two horizontally-extending plates. This type of construction has dramatically changed in recent years in that modular units are used for sheathing and finish panel require stud alignment to be exact. Sheathing has changed from wood boards to plywood, to fiberboard and now to insulating foam boards which have no structural integrity. These changes have created the need to develop new tools and procedures that provide the code required strengths.

The known procedure for fastening a vertical stud between two plates is by simply holding the stud in position and toe-nailing it to the plate using angularly driven nails. However, the driving of the nail into the stud causes both horizontal and vertical movement, therefore causing misalignment and destruction of the wood fibers that surround the nails.

Although several devices have been proposed for clamping the stud relative to the plate for the purpose of nailing, they are often only partly effective, limited in use, require a second person for their use, and demand a prohibitive amount of time.

Work holding devices for temporarily holding structural members, such as structural wood framing members used in residental construction, in a desired fixed relationship to facilitate their assembly are well known, although their use has heretofore been confined to rather limited situations. For example, structural framing holding fixtures are regularly used in factories and the like to assembly entire wall sections for use as prefabricated structural modules. However, as a result of the size and width of these fixtures, their use has not been extended to framing assembly on the job site.

In addition, on-site assembly of structural framing members presented problems of a different type than those which are usually encountered in factory jig-assembled structures. For example, temporary or permanent framing members may be required to complete or support a partially completed structure. Generally, the member to be added is manually held in place within the existing structure and nailed or otherwise fastened in place. In some instances C clamps or the like have been employed as temporary connecting fixtures. However, in either case the added member can be easily misaligned or moved by the reaction force caused by nailing, etc. This movement caused by the hammering forces may result in misalignment of the framing members, which in turn results in out-of-square, misjoined sheathing, insulating, or finish paneling, warpage of finish surfaces, etc. Additionally, the movement (horizontal movement or misalignment and vertical movement or reaction bounce) results in the natural nail retention properties of the wood and fails to achieve the structural potential of the joined framing members.

Although portable clamping fixtures have been proposed, their use has not found widespread acceptance. Some of these devices cannot be operated by a single workman or cannot accommodate differently sized structural members, or interface with the parts of the members to be joined. Other prior art devices contribute to the misalignment of the structural members by their own non-concentric weight, or are of such a size that they cannot be easily handled and transported, such as in a tool box, or are unduly complicated. It has been shown that any of these factors will discourage even the most conscientious workman from using the work holding device, even if available at the job site.

In new building construction, modular-type walls may be prefabricated with each connection made by nailing through the toe or head plate, as the case may be, into the end grains of the stud. In such construction, the end grain nailing generally has little or no structural value and relies exclusively upon the structural properties of the sheathing for the strength of the joined framing members. However, in all other perpendicularly framed construction where access is limited to one side of the framing members, toe-nailing is used. It has been said that quality toe-nailing is an art because few achieve efficiency, accuracy and structural integrity at the same time. In traditional toe-nailing, a framing stud is held in place by the workman's foot or knee at a position slightly removed from the intended position of the stud, and a first nail driven nearly vertically to join the stud and plate. Thereafter, a second nail is driven at a greater angle, which causes the stud to move to its intended position. These first two nails have little structural integrity, and act only to hold the stud in the position for subsequent nailing operations. Although subsequent nails are needed excessive or careless use of such nails may tend to splinter one or more of the structural members, reducing the strength of the connection.

SUMMARY OF THE INVENTION

The clamping tool of the present invention provides an inexpensive, easy to operate, portable work holder for accurately positioning a pair of structural members in a predetermined fixed relationship to facilitate joining the members by nailing or the like. Failure to achieve the structural potential of the framing members and misalignment of inaccuracies experienced with manual or prior art holding method are eliminated since the tool automatically aligns the structural members while at the same time maintaining the alignment regardless of reaction forces produced by nailing, etc. The tool also accommodates differently sized structural members and can be operated by the workman using only one hand, leaving the remaining hand free to position the structural members. The tool is particularly adapted to rigidly support a framing stud in a vertical position with respect to a head or sill plate prior to toe-nailing these members together with a minimum number of nails, thereby reducing splintering of the structural members and increasing their structural integrity.

The clamping tool comprises a pair of oppositely disposed substantially L-shaped opposing jaws, each jaw being substantially L-shaped in cross section and having barbed opposing surfaces for clamping a pair of wood structural framing members therebetween.

Each jaw has attached to its outermost surface one leg of a substantially L-shaped arm dimensioned to provide the necessary spacing between the barbed surfaces of the jaws when the jaws are in abutting contact with the structural members. In one embodiment, the arms are hingedly attached to the jaws to facilitate their use with a wide range of structural member sizes, thereby making the clamping tool of the present invention universal in its application. In another embodiment, the L-shaped jaws are constructed with receiving pockets at the jaw convergence for temporary attachment to commonly accepted C-jaw leverage advantage pliers.

The remaining end of one arm, designated the fixed arm, which is dimensioned to be grasped by a single hand, is rigidly attached to the forward end of an elongated channel-like handle. The other end of the remaining or movable arm is pivotably mounted to the fixed arm, such that the movable arm and its attached jaw may be brought into and out of opposing relationship with the fixed arm and its respective fixed jaw.

An elongated channel-like lever acting as an operating handle is pivotally attached to the movable arm, such that when the L-shaped jaws are separated, the operating handle and fixed handle are separated. However, when the operating handle and fixed handle are squeezed together to bring the jaws into abutting relationship with the structural members placed therebetween, the handles will be substantially parallel.

A stud lever or fulcrum bar of the desired length is pivotally connected between the side walls of the channel-like operating handle at a point inwardly of the pivotal connection between the fixed and movable arms. The free end of the fulcrum bar forms a head which coacts with the inner end of a threaded shank threadedly engaged in the free end of the fixed handle. When the handles are squeezed together and closed upon the structural members located between the jaws, the fulcrum bar will be pressed firmly against the inner end of the threaded shank to develop substantial clamping pressure between the jaws, thereby insuring that the structural members are clamped firmly in position. The L-shapes of the jaws also insure that the structural members will be automatically aligned with respect to each other, thereby eliminating inaccuracies inherent in prior art work holding tools. The threaded shank may also be provided with a thumb screw to adjust the length of travel of the head end of the fulcrum bar to adjust the jaws of the tool for various thicknesses or widths of the structural members to be clamped.

The jaws can be unlocked by means of a releasing lever of generally U-shaped cross section adapted to fit within the operating handle and kept in place by a transversely extending pin secured to the side walls of the handle. The lever is configured so that its forward end pivots or fulcrums against the fulcrum bar when the rearward end of the releasing handle is moved toward the operating handle to separate the fixed and operating handles, and consequently unclamp the jaws from the structural members. Alternatively, the releasing lever may be pivotally attached to the fulcrum bar so that the forward end pivots or fulcrums against the inner surface of the operating handle when the releasing lever is lifted or pulled toward the fixed handle.

DESCRIPTION OF THE PREFERRED EMBODIMENTS

Figure 1:
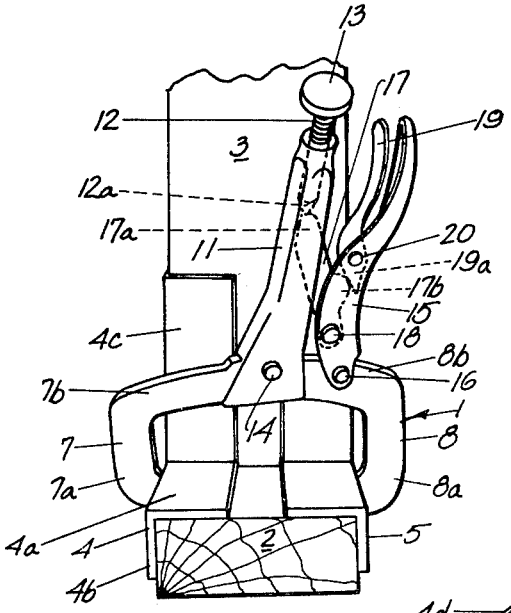
FIG. 1 is a fragmentary perspective view of the clamping tool of the present invention utilizing a releasing lever causing release upon movement toward the operating handle shown clamping a pair of perpendicularly arranged structural members.

FIG. 1 illustrates a first embodiment of the clamping tool of the present invention, shown generally at 1, clamping and positioning a pair of structural members 2 and 3. For purposes of an exemplary showing, structural member 2 may be a sill or toe plate formed from appropriate wooden framing lumber, while structural member 3 may be a typical wall stud also formed by framing lumber. The lower end of stud 3 may rest atop sill 2, or the rearmost end of sill 2 may abut the facing surface of stud 3. In general, sill 2 and stud 3 will be of substantially the same width. It will also be observed that by inverting the representation of FIG. 1, structural member 2 may be caused to represent a head plate, with structural member 3 representing the supporting stud.

Clamping tool 1 comprises a pair of generally L-shaped opposing jaws, one jaw being designated the fixed jaw 4, and the other jaw being designated the movable jaw 5. Each jaw is substantially L-shaped in cross section for conforming to the adjacent surfaces of the structural members to be joined. For example, as illustrated in FIG. 1, fixed jaw 4 comprises a horizontal L-shaped angle channel member having an upper horizontal planar member **4*a*, the lower surface of which engages the upper surface of structural member 2, and a vertical planar member 4*b* depending from the outer edge of planar member 4*a*, the inner surface of which abuts one vertical outer surface of structural member 2. Affixed to the rearmost edges of the horizontal L-shaped channel member, is a substantially L-shaped vertical channel member composed of a vertical planar member 4*c*, the lower edge of which is affixed to the rearmost edge of planar member 4*a*, and a second vertical planar member 4*d*, (see FIG. 2) attached by its frontmost edge to the outermost edge of planar member 4*c* and extending rearwardly of planar member 4*c*. The inner structural member engaging surfaces of jaw 3 may be provided with means for increasing the frictional engagement between these surfaces and the outer surfaces of the structural member, such as the inwardly projecting pointed, frictional gripping, pyramidal shaped barbs, which are sized to deeply engage the cellular construction of the wood fibers, one of which is shown at 6, in FIG. 2**.

Jaw 5 is configured in substantially the mirror-image of jaw 4, such that when the jaws are brought into opposing relationship, as shown in FIG. 1, the inner surfaces of the jaws abut at least two adjoining surfaces of each structural member, and will coact to bring the structural members to be joined into accurate alignment and position. When jaws 4 and 5 are firmly clamped together, the structural members are firmly held in the desired fixed relationship to facilitate their joinder by nailing or the like.

A generally L-shaped fixed supporting arm 7 having a downwardly depending leg *7a* and a horizontal inwardly extending leg *7b* is attached at the lowermost end of leg *7a* to the outer surface of member *4b* of fixed jaw 4. In a similar manner, a generally L-shaped movable supporting arm 8 having a downwardly depending leg *8a* and a horizontal inwardly directed leg *8b* is attached at the lowermost end of leg *8a* to the outer surface of the horizontal angle member forming movable jaw 5. It will be observed that supporting arms 7 and 8 are inclined so as to approximately bisect the angle formed by the vertical and horizontal angle members comprising jaws 4 and 5. In addition, the lengths of horizontal legs *7b* and *8b* will be dimensioned to insure that jaws 4 and 5 may be spaced to accept the largest width structural members desired.

Figure 2:
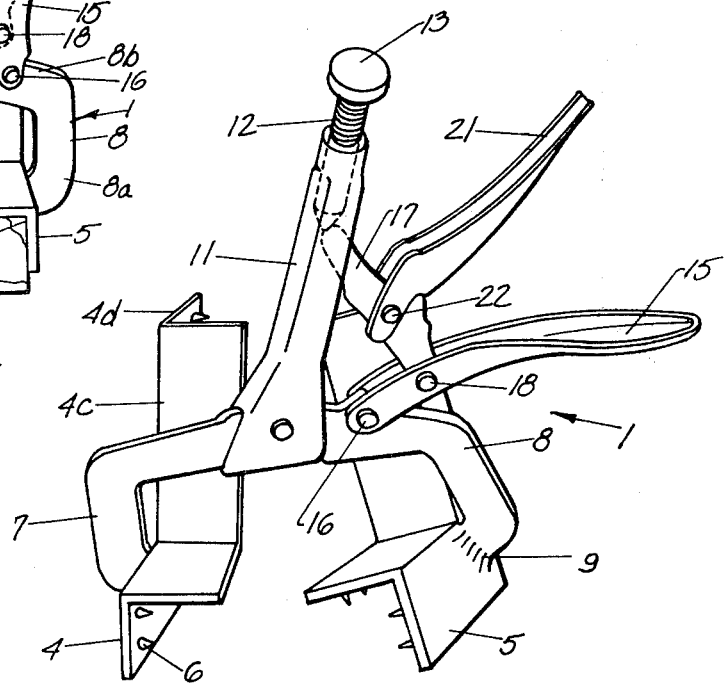
FIG. 2 is a perspective view of a second embodiment of the clamping tool of the present invention employing a releasing lever causing release upon movement of the releasing lever away from the operating handle.
Figure 3:
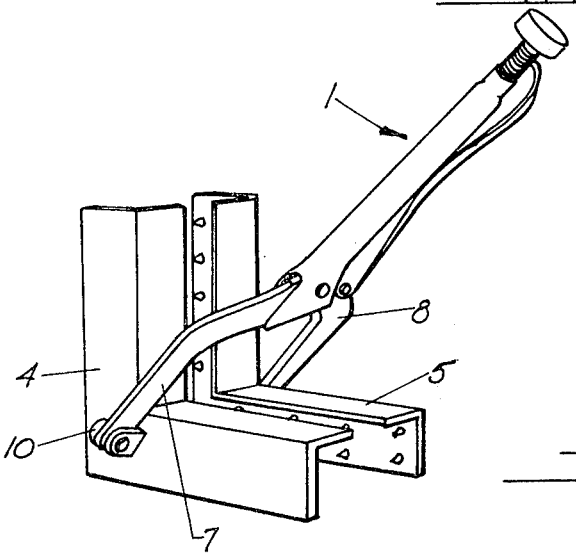
FIG. 3 is a perspective view of a third embodiment of the clamping tool of the present invention wherein the clamping jaws are hingedly attached to the supporting arms.

It will be observed that in the embodiments of FIG. 1 and FIG. 2, the lowermost ends of depending legs *7a* and *8a* of arms 7 and 8, respectively, are fixedly attached, as at 9, such as by welding, brazing, or the like, to the outer surface of their respective jaws. In an alternative embodiment shown in FIG. 3, the lowermost end of the depending legs may be pivotally attached to the outer surface of their respective jaws, such as by the hinge connection 10 extending outwardly from jaw 4 in FIG. 3. Hinge connection 10, and the corresponding hinge connection on jaw 5 (not shown) permits the jaws to pivot with respect to their supporting arms to accommodate a wide range of sizes of structural members, thereby maing a tool of universal application.

In an alternative embodiment shown in FIGS. 10–13, each of the depending legs 7, 8 includes an extension *7c*, *8c* terminating in a nose portion *7d*, *8d*, in a configuration well understood in the art and generally referred to as a C-jaw leverage advantage pliers. A receiving pocket 26 is formed at the juncture of the perpendicular portions of each L-shaped clamping jaw 4, 5. Each receiving pocket 26 receives a nose portion *7d*, *8d* of one of the extensions *7c*, *8c* of the depending legs 7, 8. A small pocket 23 at the innermost portion of each receiving pocket 26 accepts the nose *7d*, *8d* of its respective depending legs 7, 8 so as to form the bearing point 25 for the clamping forces. The remainder of the receiving pocket 26 is formed by the sides *26a* and the end retention plate *26b*, which are maintained in accurate fixed relationship between the clamping jaws 4, 5 and the depending legs 7, 8. Opposed projections 29, located at the bearing point 25, maintain the engaged relationship until the clamping jaws 4, 5 are deliberately removed from the legs 7, 8. The ribs 24 and the pocket floor *26c* strengthen the receiving pocket 26 and provide the means to transfer the clamping force to one or more framing members.

Returning to FIG. 1, it will be observed that by pivoting arms 7 and 8 inwardly, the inner surfaces of jaws 4 and 5 may be brought into abutting contact with adjoining surfaces of the structural members to provide accurate alignment and secure clamping of the members. To facilitate this clamping action, the innermost ends of the horizontal legs *7b* and *8b* are provided with a pair of actuating handles which include a locking mechanism to insure that jaws 4 and 5 remain in clamping position after pressure is released from the actuating handles, as will be described in more detail hereinafter.

The actuating handles and locking mechanism are well understood in the art in connection with hand tools generally referred to as locking pliers wrenches, such as those described in U.S. Pat. No. 2,280,005 issued Apr. 14, 1942 to W. Petersen and U.S. Pat. No. 2,514,130 issued July 4, 1950 to H. T. Jones, and generally sold under the trademark Vise Grip ® by the Petersen Manufacturing Co. of DeWitt, Nebr. Such a tool has been used in the embodiment of FIG. 1 by modifying the jaws normally associated with such a tool, and replacing them by horizontal legs *7b* and *8b*, respectively. Since the operation of the locking pliers wrench tool is well understood, it will only be briefly described.

Turning to FIG. 1, the innermost end of fixed leg *7b* is fixedly attached to an upwardly directed elongated channel-like fixed handle 11, having an outer surface adapted to be easily grasped by the hand. The upper end of fixed handle 11 contains an interiorly threaded sleeve which threadedly accepts a threaded shank 12 terminating at its upper end in a thumb screw 13. The lowermost end of threaded shank 12 terminates in a head *12a*, as is well known in the art. The innermost end of movable leg *8b* is pivotally mounted to the lowermost end of fixed handle 11 by means of rivet 14, or the like.

Positioned approximately midway along movable leg *8b* is an upwardly directed channel-like lever 15 which acts as an operating handle. The lowermost end of operating handle 15 is pivotally attached to leg *8b* by means of rivet 16 or the like.

A stud lever or fulcrum bar 17 of the desired length extends between the side walls of operating handle 15, and is pivotally attached thereto by means of rivet 18 or the like. The other end *17a* of fulcrum bar 17 abuts the lowermost head end of threaded shank 12, as is well understood in the art.

In operation, when fixed handle 11 and movable handle 15 are squeezed together so as to draw movable hand 15 toward fixed handle 11, arms 7 and 8 rotate downwardly and inwardly to bring jaws 4 and 5 into abutting contact with adjoining surfaces members 2 and 3. At the same time, fulcrum bar end *17a* slides upwardly within channel-like fixed hand 11 into abutting contact with the head end *12a* of threaded shank 12 placing fulcrum bar 17 in compression, and thereby tending to lock the fixed and operating handles together as a result of the downward pressure exerted against rivet 18, which is transmitted through the lower portion of movable hand 15 to leg *8b* of arm 8. As is well understood, the mechanical advantage provided by this type of locking mechanism is considerable, and tends to retain jaws 4 and 5 in the clamped position against adjoining surfaces of structural members 2 and 3 until handles 11 and 15 are manually separated to release the compression forces in fulcrum bar 17.

To facilitate the release of this locking mechanism and the separation of handles 11 and 15, a releasing lever 19 is provided of generally U-shaped cross section which easily fits within movable handle 15 and is kept in place by a transversely extending pin 20 secured to the side walls of handle 15, which also permits relative pivotal movement between releasing lever 19 and handle 15. The lowermost end 19*a* of releasing lever 19 is adapted to pivot or fulcrum against an upstanding rib 18*b* positioned on the edge of the fulcrum bar 17 adjacent movable handle 15, when the uppermost end of releasing lever 19 is lifted or pulled toward movable handle 15, thus permitting handles 11 and 15 to be separated to disengage jaws 4 and 5 from their clamping position.

An alternative construction for the releasing lever is shown in connection with the embodiment of FIG. 2, which depicts the type of locking plier wrench operating mechanism distributed by Sears, Roebuck & Co. In this arrangement, a releasing lever 21 of generally U-shaped cross section adapted to easily fit within movable hande 15, is pivotally attached to fulcrum bar 17 at approximately its midpoint, by means of rivet 22 or the like. The lowermost end of releasing lever 21 is adapted to pivot or fulcrum against movable handle 15 at a point between pivotal connection 18 and pivotal connection 16 when releasing lever is lifted or pulled away from movable handle 15, thereby moving the uppermost end of fulcrum bar 17 downwardly along the interior channel or fixed handle 11 to separate handles 11 and 15 and thus disengage jaws 4 and 5 from their clamped position.

All of the embodiments described heretofore include a fixed handle 11 which is provided with a threaded shank 12 which may be longitudinally moved within handle 11 by rotating thumb screw 13 to control the length of travel of the upper end of fulcrum bar 17, thereby adjusting the separation between jaws 2 and 5 to provide for differently sized structural members, as is well understood in the art.

It will thus be apparent that the tool of the embodiments of FIG. 1–FIG. 3 and FIGS. 10–12 permit a pair of structural members to be accurately positioned and securely clamped with single-handed operation by a workman. In addition, when the structural members have been joined as desired, the tool may be easily removed, again requiring only a single hand to actuate the releasing or unlocking mechanism.

Figure 4:
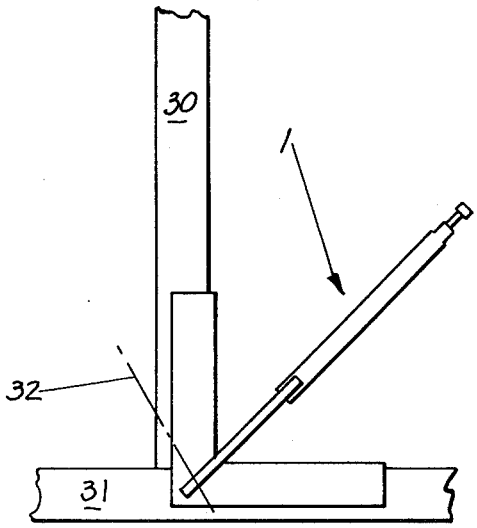
FIGS. 4–9 are fragmentary schematic views illustrating the use of the clamping tool of the present invention to clamp and position various combinations and orientations of structual framing members.

FIG. 4–FIG. 9 illustrate schematically various ways in which the clamping tool 1 of the present invention may be employed to position and clamp structural members such as might be found in temporary or permanent frames for buildings and the like. For example, FIG. 4 illustrates a side elevation view of the clamping tool 1 in position to temporarily position and hold a framing study 30 perpendicularly atop a sill plate 31, so that one or more toe-nails 32 may be driven to permanently hold the structural framing members in place. It will be observed that the placement and configuration of the clamping tool 1 provides minimal interference to the toe-nails 32.

Figure 5:
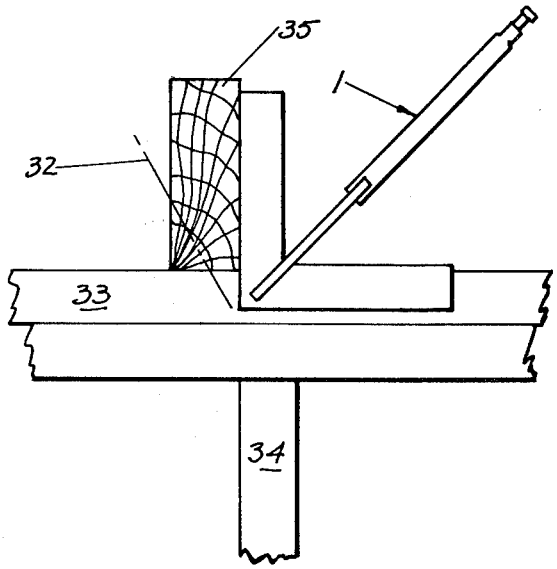

FIG. 5 represents a side elevation view of the clamping tool 1 with the horizontal portions of jaws 4 and 5 clamped longitudinally to the upper plate 33 of a double plate construction supported by stud 34, which might commonly be found in bearing walls and the like. The vertical portions of jaws 4 and 5 are not clamped to rafter or joist 35, shown in end view, but merely provide a rigid surface so that joist 35 may be accurately positioned perpendicular to and at a desired location on upper plate 33 for subsequent toe-nailing by nail 32.

Figure 6:
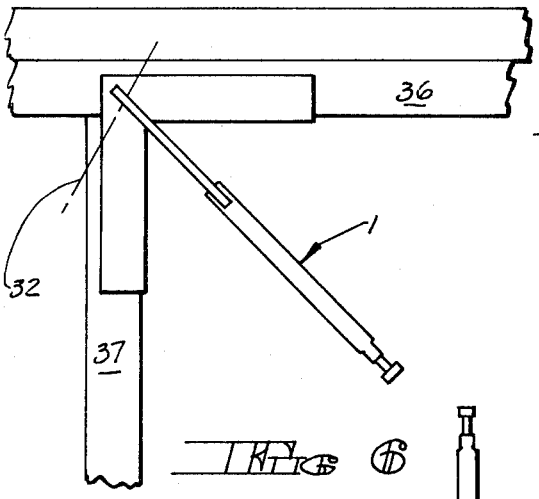

In FIG. 6 clamping tool 1 is shown clamping and positioning the lower plate or sill 36 atop supporting stud 37 for subsequent fastening by toe-nail 32.

Figure 7:
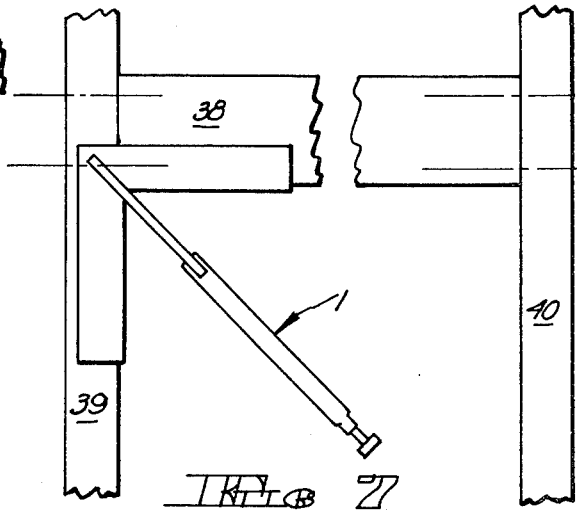

In a similar manner, FIG. 7 illustrates clamping tool 1 clamping and positioning a header 38 between a pair of supporting study 39 and 40, so that the header 38 may be end nailed to the studs. It will be apparent that a similar clamping tool may be used simultaneously with the tool shown to support the unsupported end of header 38, if desired.

Figure 8:
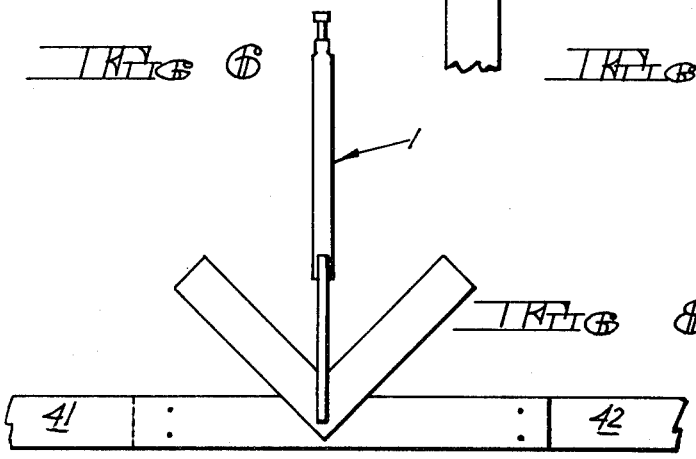

FIG. 8 illustrates clamping tool 1 used to temporarily secure a pair of overlapping members 41 and 42. Alternatively, as described hereinabove, tool 1 may be constructed such that the L-shaped angle members of jaws 4 and 5 lie substantially in a straight line thereby providing full line contact between the jaws and members 41 and 42 to be clamped.

Figure 9:
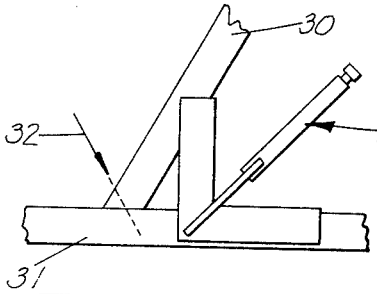
Figure 10:
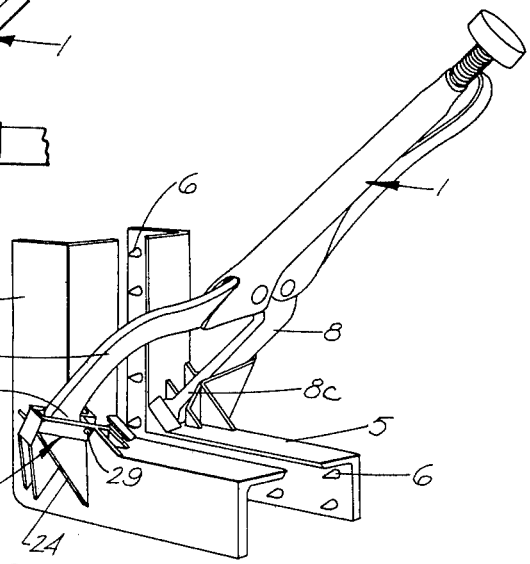
FIG. 10 is a perspective view of a further embodiment of the present invention wherein the clamping jaws, each of which is provided with a receiving pocket, are attached to the nose of a C-jaw pliers.
Figure 11:
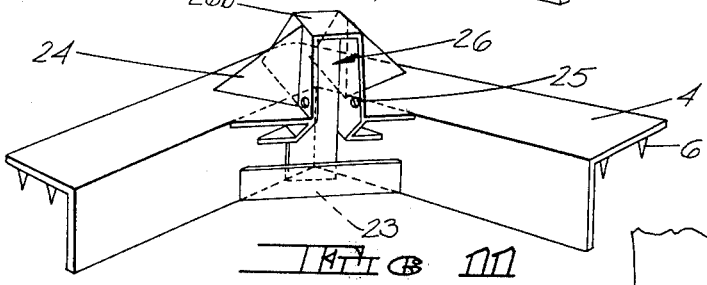
FIG. 11 is a perspective view of one L-shaped jaw of the embodiment of FIG. 10 showing the receiving pocket.
Figure 12:
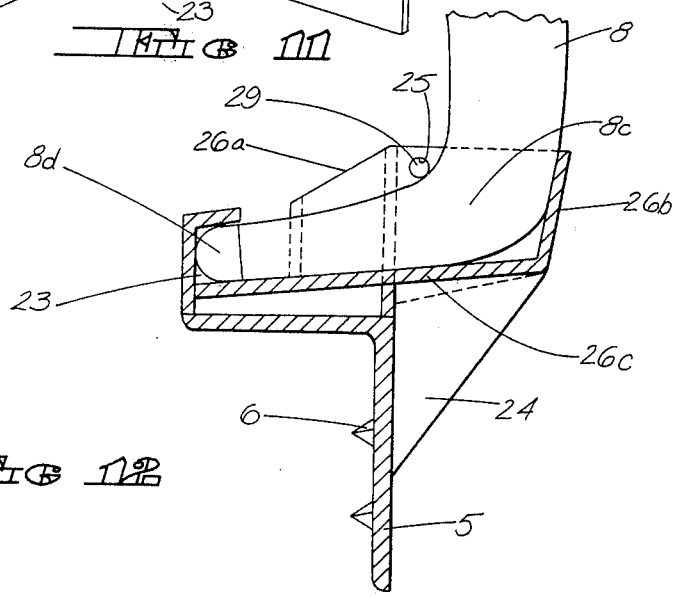
FIG. 12 is a cross sectional view, through the receiving pocket and also showing the nose of a c-jaw plies therein.

Finally, FIG. 9 illustrates a clamping tool used to secure a framing stud 30 at an acute angle against plate 31 so that one or more toe-nails 32 may be driven to permanently hold the structural framing members in place.

It will be understood that various changes in the details, materials, steps and arrangements of parts, have been herein described and illustrated in order to explain the nature of the invention, may be made by thos skilled in the art within the principle and scope of the invention as expressed in the appended claims.

The embodiments of the invention in which an exclusive property or privilege is claimed are defined as follows:

1. A clamping tool for positioning and securely holding wooden structural framing members in a fixed relationship to perfect the joining of said members, said clamping tool comprising a pair of opposed, substantially L-shaped, perpendicularly arranged, concave angle-like jaws, each said jaw being provided with a receiving pocket and being substantially L-shaped in cross section and provided with a pair of perpendicularly arranged substantially planar legs having interior surfaces adapted to contact the surfaces of said wood structural framing members, said interior surfaces being provided with frictional gripping barbs, each of said frictional gripping barbs comprising a pyramidal shaped barb sized to deeply engage the cellular construction of the wood fibers of said wood structural framing members, a supporting arm terminating in a fixed handle dimensioned to be grasped by a single hand and being releasably engaged in said receiving pocket of one said jaw, a movable arm pivotally attached to said fixed handle, said movable arm being releasably engaged in said receiving pocket of the other of said jaws, an operating handle pivotally attached to said movable arm between said fixed handle and said other jaw for moving said other jaw between a closed clamping position, wherein said jaws are in abutting contact with the structural members to hold said members in said fixed relationship, and an open position, wherein said jaws are spaced from said structural members to facilitate positioning said clamping tool on or removing said clamping tool from said wood structural framing members, locking members actuated by squeezing together said fixed and movable handles for retaining said jaws in said closed clamping position with said wood structural framing members, said locking means comprising a bar-like stud lever pivotally attached to said movable handle and including a contact end extending toward said fixed handle, said fixed handle including a shank having a head portion adapted to abut said contact end, said contact end being brought into firm engagement with said shank head to place said stud lever in compression when said handles are squeezed together, said compression forces being transmitted through said handles and said arms to said jaws to restrain said jaws in closed clamping position, means for adjusting the spacing between said jaws when said jaws are in the closed clamping position, said adjusting means comprising means for adjusting the length of said shank to vary the travel distance of said stud lever, and unlocking means in association with said locking means for separating said handles to permit moving said jaws to said open position.

2. The clamping tool according to claim 1, wherein said unlocking means comprises a releasing lever pivotally attached to said stud lever, the end of said releasing lever adjacent said pivotally attachment comprising a contact point, the opposite end of said releasing lever forming a handle, said contact point being operable to abut said operating handle when said releasing lever handle is moved away from said operating handle when said jaws are in the closed clamping position to move said stud lever out of contact with said shank head causing said fixed and operating handle to separate to release said locking means.

3. The clamping tool according to claim 1 wherein said unlocking means comprises a releasing lever pivotally attached to said operating handle and containing a contact end between said pivotal attachment and said stud lever, said stud lever including an upstanding rib adapted to abut said contact end of said releasing lever when said jaws are in said closed clamping position, the end of said releasing lever opposite said contact end forming a handle and being movable towards said operating handle to lift said stud lever away from said operating handle to separate said fixed and operating handles and release said locking means.

* * * * *